United States Patent [19]

Okerlin

[11] 4,377,284

[45] Mar. 22, 1983

[54] BASKETBALL TRAINING DEVICE

[76] Inventor: John Okerlin, Rte. 1, Box 15-A-1, Umatilla, Fla. 32784

[21] Appl. No.: 279,557

[22] Filed: Jul. 1, 1981

[51] Int. Cl.[3] ..... A63B 69/00

[52] U.S. Cl. ..... 273/1.5 A; 273/189 R; 128/133

[58] Field of Search ..... 273/1.5 A, 189 R; 272/142; 128/133, 134

[56] References Cited

U.S. PATENT DOCUMENTS

| | | | |
|---|---|---|---|
| 1,655,092 | 1/1928 | Davis | 273/189 R |
| 2,450,162 | 9/1948 | Promen | 128/134 X |
| 2,650,590 | 9/1953 | Moore et al. | 128/134 |
| 3,970,316 | 7/1976 | Westmoreland, Jr. | 128/134 X |
| 4,239,228 | 12/1980 | Norman et al. | 128/134 X |

FOREIGN PATENT DOCUMENTS

| | | | |
|---|---|---|---|
| 20463 | of 1907 | United Kingdom | 273/189 R |

*Primary Examiner*—Paul E. Shapiro
*Attorney, Agent, or Firm*—Roger L. Martin

[57] ABSTRACT

A basketball player's training device is designed to maintain the player's elbows in close proximity when making practice shots. It includes a pair of sleeves that are stretchable and snuggly fit over the forearms of the player adjacent to the elbows, and a stretchable member that interconnects the sleeves during use. At one end of the interconnecting member, the device is equipped with a releasable fastener of the hook and loop type for fastening the member to the sleeve and which can be easily manipulated when the sleeves are on the player's forearms.

3 Claims, 6 Drawing Figures

BASKETBALL TRAINING DEVICE

BACKGROUND OF THE INVENTION

The invention relates to basketball player training devices or aids for basketball players, and more particularly to aids or devices for training basketball players in the proper methods of shooting baskets.

A major problem in training young basketball players is that of initiating the use of proper shooting techniques which thereafter become habitual and are automatically followed as the players' shooting skills are developed. The novice has a tendency to aim and shoot the ball at too low a level for proper control of the ball trajectory and has the further tendency, when shooting the ball from the desired higher levels, to rely too much on the wrist action of both arms in projecting the ball toward the basket. The use of both arms to project the ball toward the basket is undesirable because one arm usually dominates and over powers the other. This causes the ball to take on an improper trajectory.

It is known that if the power for propelling the basketball toward the basket is provided by the dominant arm while the other arm serves to guide the ball as it is being projected, a proper trajectory is more frequently attained.

Devices for training the basketball player to project the ball toward the basket when the arms are at a desired high level are known. (See U.S. Pat. No. 3,820,703) Such devices however are bulky and cumbersome and fail to urge the player to limit use of its subservient arm to that of guiding the ball along the trajectory so that the propelling force eminates from the dominant arm. As such, there is a need for improved devices for training basketball players in the proper methods of shooting baskets and which not only emphasize the need for shooting the ball at a high level but for the use of the dominant arm as the source of power for propelling the basketball along the trajectory to the basket.

SUMMARY OF THE INVENTION

It has been found that the use of both arms to propel the basketball on a trajectory toward the basket is discouraged and that use of the dominant arm for imparting the force to the basketball for propelling it along the trajectory is encouraged if movement of the players' elbows is restricted by maintaining them in close proximity during the process of projecting the ball along its intended trajectory. This is accomplished in accord with the invention through the use of a pair of sleeves which are adapted to snuggly fit on the forearms of the player and which are so interconnected as to maintain the players' elbows in close proximity to one another as the ball is projected or cast toward the basket by the player. In the preferred form of the training device, the sleeves are made of material that permits circumferential stretching and recovery of the tubular sleeves so that they will surround and remain immobile when placed on the players' forearms. The sleeve interconnecting member is also made of elastic material which also permits the member to stretch and recover from the stretching process as the need arises. One aspect of the invention has to do with the arrangement used in attaching the sleeves to the interconnecting flexible member so as to facilitate the proper orientation of the arms as the ball is being projected toward the basket.

BRIEF DESCRIPTION OF DRAWINGS

The novel features which are believed to be characteristic of this invention are set forth with particularity in the appended claims. The invention, itself, however, both as to its organization and method of operation, together with further objects and advantages thereof, may best be understood by reference to the following descriptions taken in connection with the accompanying drawings, wherein:

DESCRIPTION OF PREFERRED EMBODIMENT

Figure 1:
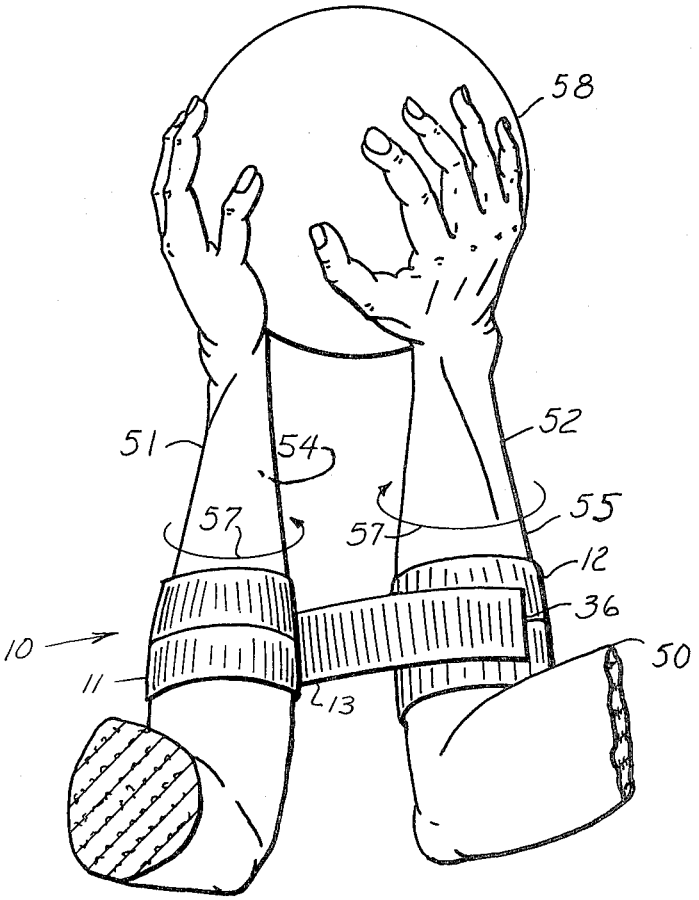
FIG. 1 is an isometric view showing the training device as attached to the forearm of a basketball player during the process of projecting the ball toward a basket.

Reference is now made to the drawings and wherein a training aid or device for training and developing the shooting skills of a basketball player is designated at 10. The device 10 includes a pair of flexible tubular sleeve components 11 and 12 that are adapted to fit on the forearms of a player, and a flexible member 13 that serves to interconnect the sleeve components 11 and 12 during use of the device 10.

Sleeve component 11 is prepared from a flat band 16 of relatively wide elastic material in which the threads or yarns of the warp are resilient and made from suitable elastic material, such as rubber. The opposite ends 17 of the elastic band 16 are overlapped and sewn together in forming the sleeve component 11. This provides the tubular sleeve component 11 with a capability of being stretched in the circumferential direction indicated by arrow 18 to facilitate the reception of the players' forearm through the opening 19 in the sleeve and to thereafter provide a snug fit of the sleeve on the players' forearm upon recovery of the stretch material.

The other sleeve component 12 is also prepared from a flat band 22 of relatively wide material in which the threads or yarns of the warp are resilient and made from suitable elastic material , such as rubber. Like band 16 the opposite ends 23 of band 22 are overlapped and also sewn together in forming the sleeve component 11. Again, the arrangement provides the flexible sleeve component 12 with the capability of being stretched circumferentially in the direction of arrow 24 to facilitate reception of the players' arm in the opening 25 and to thereafter provide a snug fit on the arm when the material recovers from being stretched.

Although the size of the band used in preparing the sleeve may vary widely, a typical band may be 10 cm. wide and 25 cm. long with a 1 cm. margin at each of its opposite ends being used for overlap in attaching the ends together to provide the annular structure.

The use of preformed flexible tubular sleeves which are circumferentially stretchable is preferred over the use of non-stretchable sleeves or sleeves formed from bands which are simply wrapped around the arm and secured by releasable fasteners. Sleeves made from non-elastic materials fail to provide the snug fit desired to prevent rotation of the sleeves on the players' forearms and which, as will be subsequently seen, detracts from the use of the hook and loop type fasteners desired for releasably interconnecting the flexible member 13 at one of the sleeves. The use of releasable fasteners in forming the tubular components is also undesirable in that they tend, to the annoyance of the player, to become unfastened or loosened during use.

The interconnecting member 13 is made from an elongated and relatively narrow flat piece or band 28 of elastic material in which the threads or yarns of the warp are also resilient and made, for example, from rubber or similarly resiliently stretchable material. This enables the interconnecting member 13 to be stretched longitudinally, as in the direction of arrow 29, when the device is in use and thus provide a yieldable resistance to movement of the players' elbows out of the closely proximal positions desired during the shooting process. A typical band 28 may be about 5 cm. wide and about 30 cm. long with 5 cm. being allowed at each of its opposite ends 30 and 31 to overlap the outer side faces 32 and 33 of the sleeves 11 and 12 respectively.

The sleeve interconnecting member 13 is securely fastened to sleeve component 11 with an end portion 35 at the one end 30 of the band 28 being arranged to overlap the outer side face 32 of sleeve 11 in a manner such that the one side face 38 at the end 30 of band 28 confronts the outer side face 32 of the sleeve 11. Here the end portion 35 of band 28 is securely fastened to the sleeve 11 by means of stitches 41.

At the other end 31 of member 13, band 28 is equipped with a rectangular strip 43 of material that has a looped pile 47 and which is fastened to the other end portion 36 of member 13 and at the other side face 39 of the band, as by means of stitches 44. Strip 43 is designed to cooperate with a rectangular strip 45 in releasably fastening the member 13 to sleeve 12. Strip 45 has a hooked pile 48 and is securely fastened to the outer side face 33 of sleeve 12 as by means of stitches 46. The loop and hook strips 43 and 45 are of the typed commonly marketed under the trademark Velcro as releasable or separable fasteners. The structure of such strips and the means by which they cooperate in fastening the parts together is readily apparent from the De Mestral U.S. Pat. Nos. 2,717,437; 2,933,797; 2,083,737; 3,009,235; and 3,154,837. The loop strip 43 has a pile composed of a plurality of closely arranged individual loops and the hook strip 45 has a pile composed of a plurality of closely arranged hooks that become entangled with the loops when the piles of the strips 43 and 45 are brought into facial contact to fasten the strips together. The arrangement when the piles of the strips 43 and 45 are pressed together is such as to present a sizable resistance to separation by forces parallel to the plane of facial contact between the hooked and looped strips while nevertheless presenting little resistance to separation of the piles by forces that tend to peal one strip away from the other as is well known in the art.

The arrangement of the fastening strips 43 and 45 at the end 31 of band 28 is such that the one side face 39 of the band 28 confronts the other side face 33 of sleeve 12 when the member 13 is fastened to the sleeve 12, whereas the other side face 38 of the band 28 confronts the outer side face 32 of the other sleeve component 11. This arrangement where the outer side faces of the sleeves are confronted by the opposite side faces of the interconnecting band 28 when the sleeves are interconnected thereby, facilitates the use of the hook and loop type fastener arrangement between the interconnecting member 13 and sleeve 12 and a relatively minimal use of material for interconnecting the sleeve components.

Figure 2:
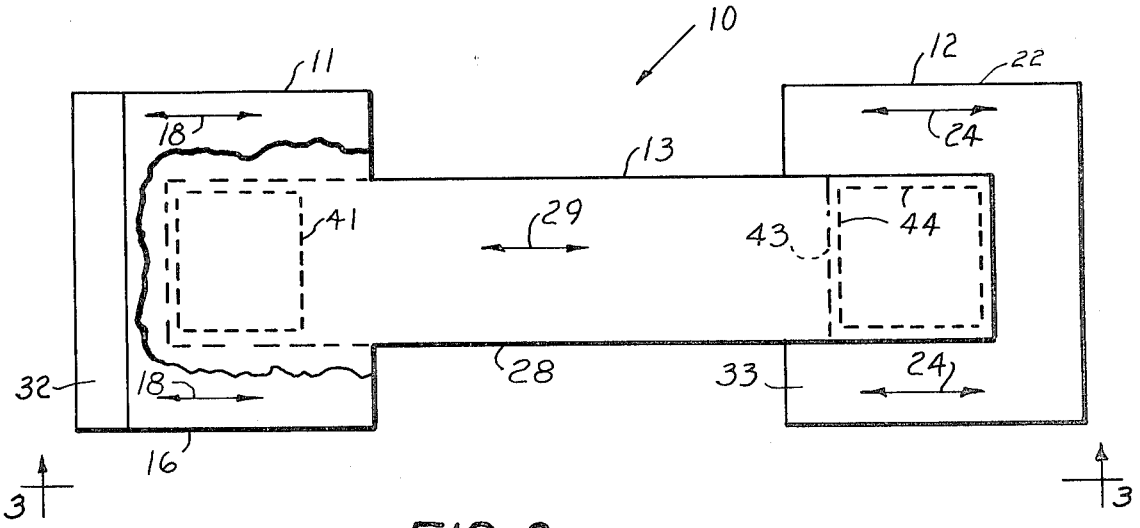
FIG. 2 is a top plan view of the device seen in FIG. 1 and as seen when detached from the players' arms.
Figure 3:
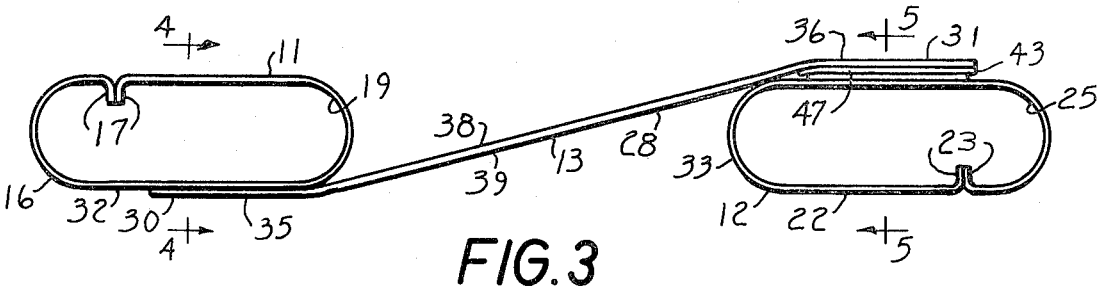
FIG. 3 is a side elevational view taken generally along the Lines 3—3 of FIG. 2.
Figure 4:
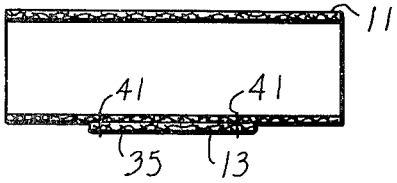
FIG. 4 is a cross sectional view through one sleeve of the device and as generally taken along the Lines 4—4 of FIG. 3.
Figure 5:
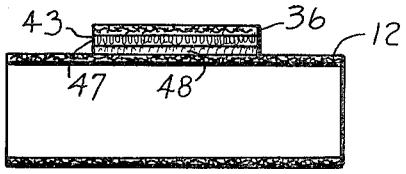
FIG. 5 is a cross sectional view through the other sleeve as taken generally along the Lines 5—5 of FIG. 3.
Figure 6:
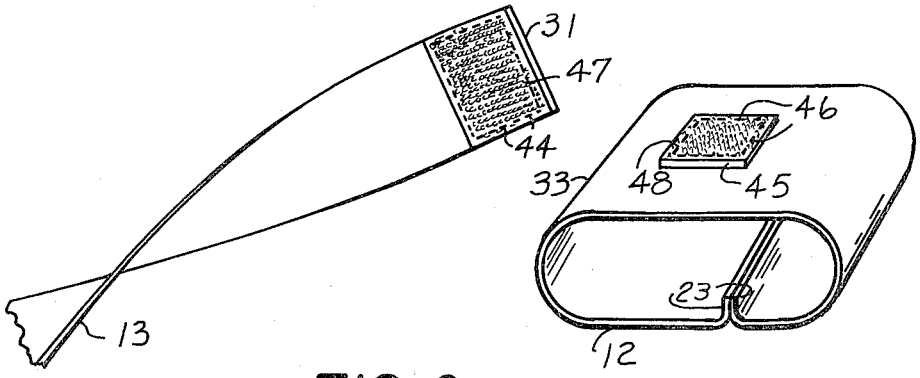
FIG. 6 is a fragmentary view showing the detachable fastening means used in attaching the interconnecting member to one of the sleeves.

FIG. 1 illustrates a preferred method of using the training aid or device 10. As seen therein, sleeve component 11 is arranged on the left forearm of the basketball player whose right forearm 52 is dominant. When properly arranged, the sleeve component 11 is oriented so that the attached end portion 35 of member 13 overlies the inside 54 of the forearm 51 and the other sleeve component 12 is arranged so that the other end portion 36 of member 13 overlies the outside 55 of the dominant forearm 52. This permits the player 50 to comfortably support the basketball 58 on the fingers of the right arm as it is being projected along its trajectory by right arm wrist and arm action and to simultaneously guide the ball with the left hand at the left side of the ball. As seen in FIG. 2, any tendency to move the elbows apart will exert a force on the loop and hook piles which is substantially parallel with the arrangement of the strips 43 and 45 and hence will present a large resistance to separation of the strips 43 and 45 so long as the sleeves snuggly fit and resist rotational movement of the forearms. The resistance to parting movement of the elbows caused by the flexible member 13 of the device 10 serves to signal the player that his elbows are moving into an improper shooting relation. After continuous use of the device in practice sessions, the maintenance of the elbows in close proximity becomes automatic when the ball is being shot.

Although fasteners, other than loop and hook type fasteners, such as buttons, snaps, and metal hook elements, may be used in accord with broader aspects of the invention, such devices are generally unacceptable because they are difficult or almost impossible to manipulate by the player per se in view of the location of the sleeves relative to the elbows. As such, these other types of elements usually require a second person to apply the device to the novice player. On the other hand, the use of the hook and loop pile arrangement provides a releasable fastener which may be satisfactorily manipulated by the player per se. To prevent detachment, the sleeves are arranged so that the forces resisting detachment or release of the hook and loop type fastener are generally parallel to the strips 43 and 45 when the shot is being made as generally illustrated in FIG. 1. On the other hand, the sleeve 12 may be released from the interconecting member 13 with relatively little difficulty by simply rotating the forearms inwardly, as depicted by the arrows 57 in FIG. 1 and to positions at which the strips 43 and 45 may be pealed apart by lateral movement of the players' arms.

While only one embodiment of this invention has been shown and described by way of illustration, many modifications will occur to those skilled in the art and it is, therefore, desired that it be understood that it is intended herein to cover all such modifications that fall within the true spirit and scope of this invention.

What is claimed as new and what it is desired to secure by Letters Patent of the United States is:

1. A training device for a basketball player comprising a pair of sleeves that are adapted to snuggly fit on the forearms of the player, and elongated means interconnecting said sleeves for maintaining the players' elbows in close proximity, said elongated means being an elongated narrow and flat resiliently stretchable member with opposite side faces and opposite ends, said sleeves having respective outer side faces, said member being fastened at one of its opposite ends to one of said sleeves and in an arrangement where one of the opposite side faces of the member facially confronts the outer side face of said one of said sleeves, and said member being releasably fastened at the other of its opposite ends to the other of said sleeves and in an arrangement where the other of the opposite side faces of the member confronts the outer side face of the other of said sleeves.

2. A training device for a basketball player in accord with claim 1 wherein said member is releasably fastened to the other of said sleeves by interconnected hook means and loop means, one of said hook means and loop means being fastened to said member, and the other of said hook means and loop means being fastened to said other of said sleeves.

3. A training device for a basketball player comprising a pair of sleeves that are circumferentially resiliently stretchable and adapted and arranged to snuggly fit on the forearms of the player, and an elongated narrow flat and longitudinally resiliently stretchable member interconnecting said sleeves for maintaining the players' elbows in close proximity, said member having opposite side faces and opposite ends, said sleeves having respective outer side faces, said member being fastened at one of its opposite ends to one of said sleeves and in an arrangement where one of said opposite side faces of the member facially confront the outer side face of said one of said sleeves, said member being releasably fastened at the other of its opposite ends to the other of said sleeves and in an arrangement where the other of the opposite side faces of the member confronts the outer side face of the other of said sleeves, said member being releasably fastened to the other of said sleeves by interconnected hook means and loop means, one of said hook means and loop means being fastened to said member, and the other of said hook means and loop means being fastened to said other of said sleeves.

* * * * *